United States Patent [19]

Verhoff

[11] 4,067,395

[45] Jan. 10, 1978

[54] LAND LEVELER WITH RELATIVE HEIGHT CONTROL

[76] Inventor: Leonard J. Verhoff, Rte. No. 2, Continental, Ohio 48531

[21] Appl. No.: 662,580

[22] Filed: Mar. 1, 1976

[51] Int. Cl.[2] ..... E02F 3/76

[52] U.S. Cl. ..... 172/4.5; 172/780

[58] Field of Search ..... 172/4, 4.5, 779, 780, 172/804; 37/DIG. 1, DIG. 13, DIG. 14, DIG. 20; 404/84; 74/25, 424.8 B

[56] References Cited

U.S. PATENT DOCUMENTS

| | | | |
|---|---|---|---|
| 2,846,792 | 8/1958 | Hobday | 172/4.5 |
| 3,272,021 | 9/1966 | Weber | 74/25 |
| 3,319,481 | 5/1967 | Goodman | 74/424.8 R |
| 3,353,288 | 11/1967 | Waterson | 172/4.5 |
| 3,428,133 | 2/1969 | Young et al. | 172/4.5 |
| 3,437,825 | 4/1969 | Studebaker | 172/4.5 X |
| 3,516,497 | 6/1970 | Waterson | 172/4.5 |
| 3,527,539 | 9/1970 | Studebaker | 356/156 |
| 3,658,133 | 4/1972 | Sweet et al. | 172/4 |
| 3,724,556 | 4/1973 | Servatius | 172/4.5 |

FOREIGN PATENT DOCUMENTS

| | | | |
|---|---|---|---|
| 217,233 | 9/1961 | Austria | 172/4 |
| 40,888 | 7/1958 | Poland | 172/4 |
| 191,922 | 3/1967 | U.S.S.R. | 172/780 |

*Primary Examiner*—Richard T. Stouffer
*Attorney, Agent, or Firm*—David H. Wilson

[57] ABSTRACT

A tractor drawn implement having a blade engageable with the ground and adjustable as to its depth of engagement whereby depth is increased over high spots and depth is decreased over low spots to transfer soil from high spots to low spots as the implement traverses the ground. A gauge frame trails a main frame carrying the blade and is coupled to a gauge beam whose elevation with respect to the main frame is altered as a function of the elevation of the gauge frame relative to the main frame and/or blade. The gauge beam is coupled to the gauge frame so that the articulation between the gauge frame and main frame provided for convenience in manipulating the implement and the freedom of transverse motion between frames is enabled without displacing the gauge beam from an operative relationship with control elements adjustably mounted on the main frame. Electro-hydraulic controls are illustrated. Solenoid operated hydraulic valves control the admission of fluid to a drive cylinder for pivoting ground engaging wheels on the main frame to raise and lower the frame and blade relativeto the underlying ground surface. Gauge beam supported limit switches control the valve solenoids and are actuated by cams supported on the main frame. A movable base for the cams has a motor driven positioner to raise or lower it and change the operative positions for the switches. The cams can be moved relative to the base for further adjustment of the actuating positions and dead zone range of relative motion.

12 Claims, 7 Drawing Figures

LAND LEVELER WITH RELATIVE HEIGHT CONTROL

BACKGROUND OF THE INVENTION

Various forms of land levelers are known including wheel supported frames upon which blades are mounted either in fixed elevational relation to the frame, in which case the elevation of the support wheels is varied to smooth irregularities in the contour of the underlying ground, or in movable relationship to the frame in which the wheel height on the frame can be fixed while blade height is varied to correct contour variations, or by interrelated combinations of blade and wheel height adjustment. It is desirable, particularly in agricultural land levelers that the response to the irregularities in the surface be automatic and rapid so that the cut-and-fill is accomplished as the implement is drawn across a field without continuous manual adjustment.

Changes in the inclination of the tractor with respect to the main frame of the implement and in the inclination of a trailing frame with respect to the main frame have been utilized as the means of actuating the automatic adjustment of the blade elevation. The following United States patent disclosures are typical of these types of implements:

Shumaker: 2,650,441 — of Sept. 1, 1953
Hobday: 2,792,651 — of May 21, 1957
Shumaker et al.: 2,842,874 — of July 15, 1958
Murray et al.: 3,080,666 — of Mar. 12, 1963
Waterson: 3,353,288 — of Nov. 21, 1967
Young et al.: 3,428,133 — of Feb. 18, 1969
Waterson: 3,516,497 — of June 23, 1970

Generally, the change in elevation or inclination between gauge means and the blade or blade carrying frame has been caused to act either directly through a mechanical linkage or through hydraulic means to cause a compensating change in the effective height of the ground engaging blade or blade and frame and thus has required rugged gauging means and direct drive linkages. In Young et al. U.S. Pat. No. 3,428,133, an electrical sensing means in the form of spaced limit switches is illustrated within a gauge beam and is electrically coupled to a hydraulic system to establish the flow of hydraulic fluid to a hydraulic drive cylinder which raises or lowers the front frame section and the blade carried by that section so as to maintain the working level of the cutting blade.

SUMMARY OF THE INVENTION

The present invention relates to land levelers and more particularly to depth of cut control mechanisms for land levelers. In the illustrated embodiment the depth of cut control utilizes a gauge arm which is maintained in elevational relationship with a main frame of a land leveler while so coupled to a gauge frame articulated with the main frame as to permit a wide range of operative relationships between the frame. The coupling is in the form of an upright member which can be mounted by a universal coupling on the main frame and provides independent, universal, pivotal freedom of motion for the gauge frame and constrained motion in a longitudinal plane and the implement for the gauge arm.

Limit switches are mounted on the distal end of the gauge arm as controls for solenoid actuated hydraulic valves to a wheel elevating and depressing hydraulic cylinder drive. The limit switches are responsive to cams mounted on the main frame to engage an up cam with an up switch and drive the wheels downward to effectively raise the leveler blade and main frame when the gauge frame is higher or main frame lower than the desired ground plane. Conversely, when the gauge frame is lower or the main frame higher than the desired ground plane, the blade and main frame are depressed by operative engagement of a down switch on the gauge arm with a down cam on the main frame. All controls and linkages are on the main frame in this arrangement.

A wide range of adjustment of operating points for the cut control mechanism is provided by individual adjustment of one or both of the operating cams, and adjustment of the cam assembly position along the path of operating motion of the switch carrying portion of the gauge arm. A cam assembly in the form of a slide mounted base affords adjustment from remote locations, such as the tractor drivers seat, by virtue of an electrical motor driven screw drive.

A long gauge arm, typically of the order of one third the length of the gauge beam, enables the actuating controls to be quite sensitive to changes in the relative elevation of the main frame and gauge beam. In particular, the actuating cams of the cut control can be set to be responsive to a change of the beam position of the order of a fraction of an inch. Such close control tends to produce hunting in the operation of the elevating mechanism. Hunting has been minimized by locating the pivot around which the gauge frame and gauge arm move relative to the main frame in a vertical plane containing the axis of rotation of the wheels on the main frame which adjust the depth of cut of the blade.

Where desired, response of the cut control is maintained even while turning through a short radius turn since the pivoting of the gauge frame through the turn does not pivot the gauge arm on the common upright member functioning as a pintal for the gauge frame. The gauge arm is constrained to positions retaining operative relationships between the limit switches and cams by the universal joint mounting and is dampened in its motion by means of shock absorbers secured to the main frame and coupled to the gauge arm.

Spaced gauge wheels on the gauge frame are arranged to accommodate transverse irregularities in the terrain since a universal mounting of the upright member of pintal accommodates lateral canting of the gauge frame relative to the main frame and inclination of the pintal out of the fore and aft vertical plane while the gauge arm constraint retains the sensing elements on the gauge arm in operative relationship with the control cam assembly.

BRIEF DESCRIPTION OF THE DRAWINGS

The above and additional features of this invention will be appreciated more fully from the following detailed description when read with reference to the accompanying drawings in which.

DETAILED DESCRIPTION OF A PREFERRED EMBODIMENT

Figure 1:
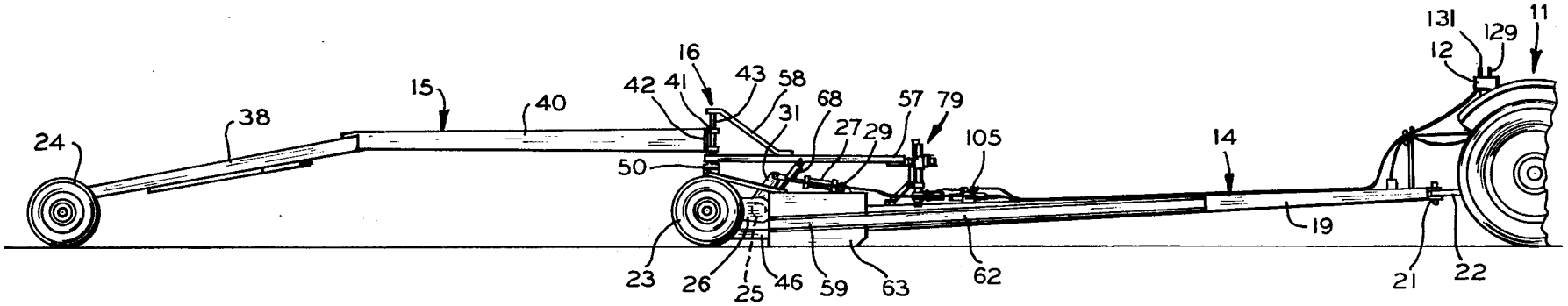
FIG. 1 is a side elevational view of a land leveler according to this invention illustrating it coupled to a tractor which has been broken away at its forward portion.
Figure 2:
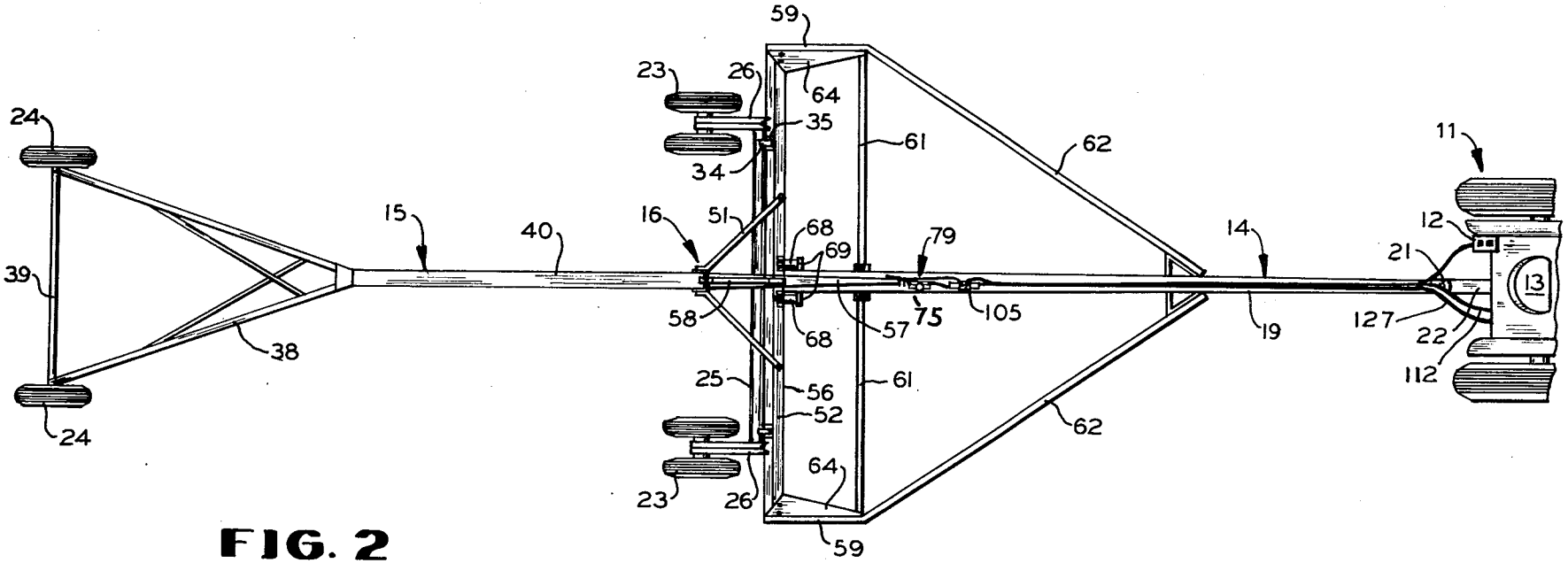
FIG. 2 is a top plan view of FIG. 1.

FIGS. 1 and 2 illustrate the general relationship of the several elements of a land leveler according to this invention and an associated tractor 11 provided with a control station 12 for the leveler adjacent the drivers station 13. The land leveler includes a main frame 14 and a gauge frame 15 pivotally connected to the main frame at 16. The main frame 14 is integral with a ground working blade 18 illustrated as fixed on the main frame transverse of its longitudinal axis and main beam 19. A suitable coupling 21 is secured to the drawbar 22 of tractor 11 which can have hydraulic elevating means (not shown) and be of conventional form.

In operation the land leveler is intended to develop a smooth flat contour to the terrain over which it is drawn by establishing a uniform elevational relationship between main frame 14 and gauge frame 15. Deviations from the desired relationship are indicated by a change in the elevational relationships. Main frame 14 is supported by wheels 23 and gauge frame 15 is supported by wheels 24. When the underlying ground contour raises wheels 24 relative to wheels 23 or lowers wheels 23 relative to wheels 24, blade 18 is raised to deposit soil being carried ahead of it thereby filling the sensed declivity. Conversely, when a rise in contour is sensed by a relative dropping of gauge wheels 24 or an elevating of wheels 23, blade 18 is lowered to remove soil and cut-away the rise. These cut-and-fill functions are preformed by adjusting the height of the main frame 14 and blade 18, in the example at the rear portion of the main frame, by rotating a rock shaft 25 from which extend cranks 26 mounting main wheels 23.

A drive mechanism in the form of a hydraulic cylinder 27 containing a piston (not shown) and having a piston rod 28 extending rearwardly and a pillow block mounting 29 on main beam 19, moves wheels 23 downward as rod 28 is extended. A drive crank 31 is engaged by piston rod 28 through a suitable coupling such as clevis 32. Crank 31 is fixed on rock shaft 25 to impart arcuate motion to the shaft around pintals 33 (FIG. 3) journaled in gudgeons of ears 34 secured as by welding to rock shaft 25 and secured to ears 35 fixed on the blade 18, thereby pivoting cranks 26 counter-clockwise as viewed in FIGS. 1 and 3 to raise the frame and blade and counter-clockwise to lower them. Cylinder 27 provides a driving force both to lower and to raise main wheels 23 since it is double ended, having hydraulic coupling 36 at its forward end and coupling 37 at its rear.

Figure 3:
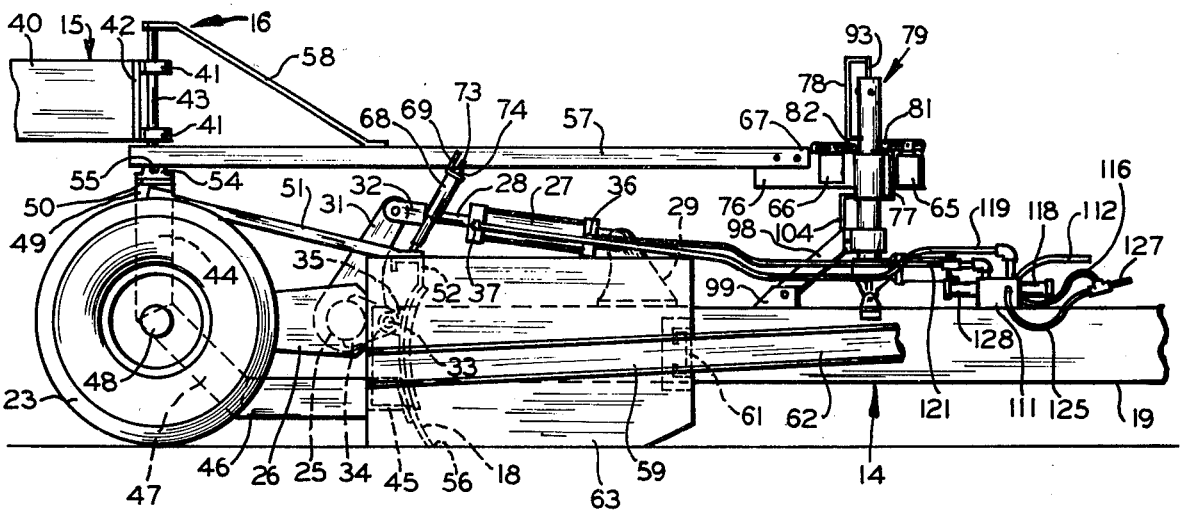
FIG. 3 is a partially broken away enlarged side elevational view of the portion of the implement of this invention which senses the changes in contour, actuates elevating mechanisms, and alters the elevation of the ground engaging blade.
Figure 6:
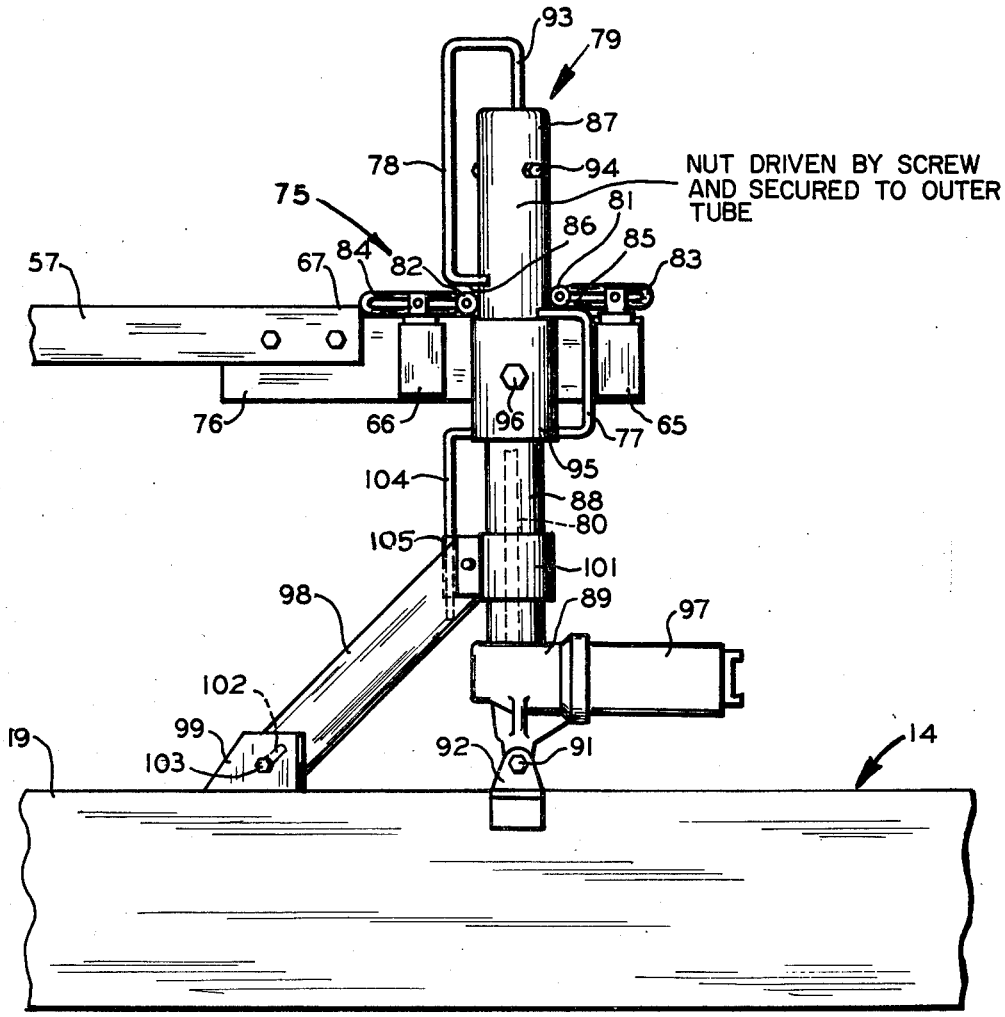
FIG. 6 is an enlarged side elevational view of the cam assembly and limit switches providing control of the elevating mechanism.
Figure 4:
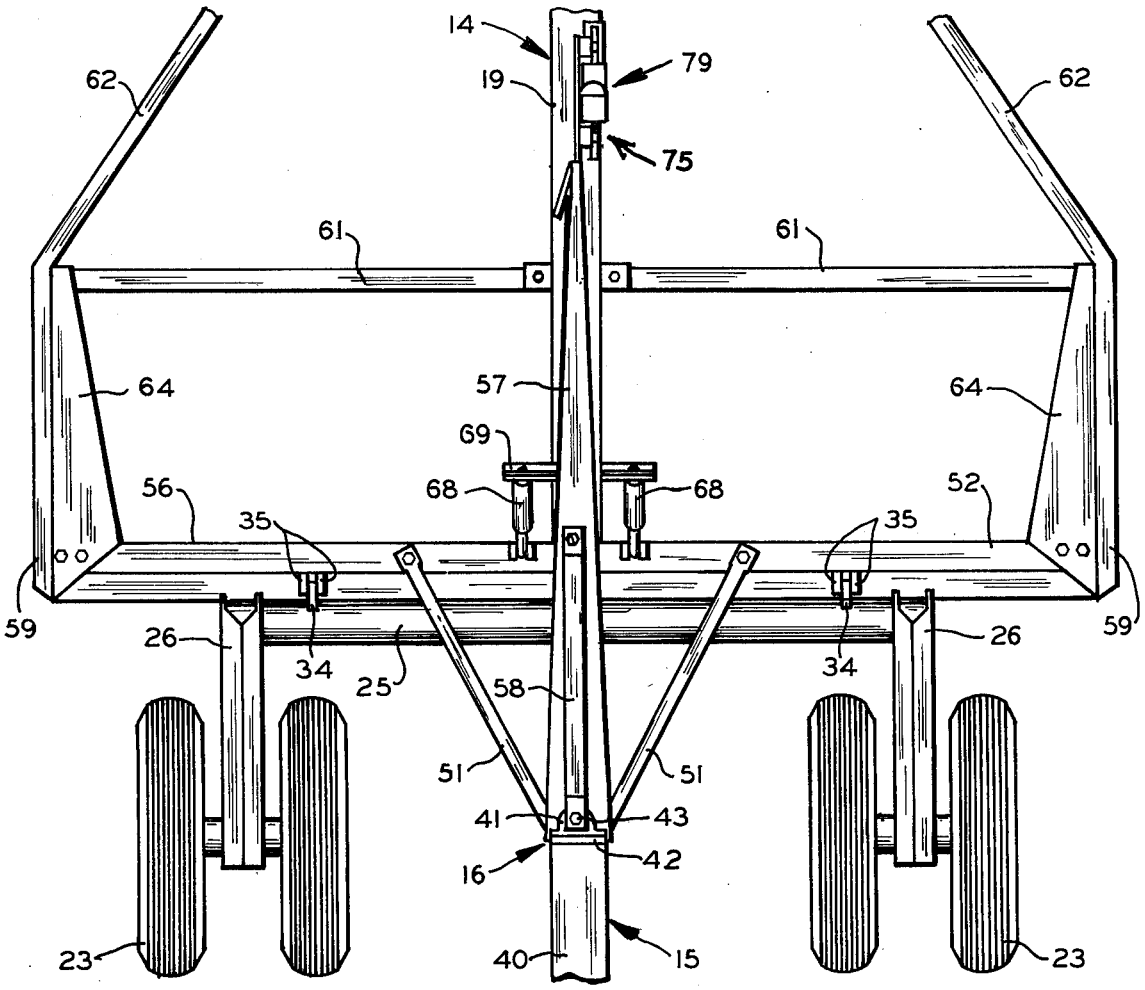
FIG. 4 is an enlarged plan view of FIG. 3.
Figure 5:
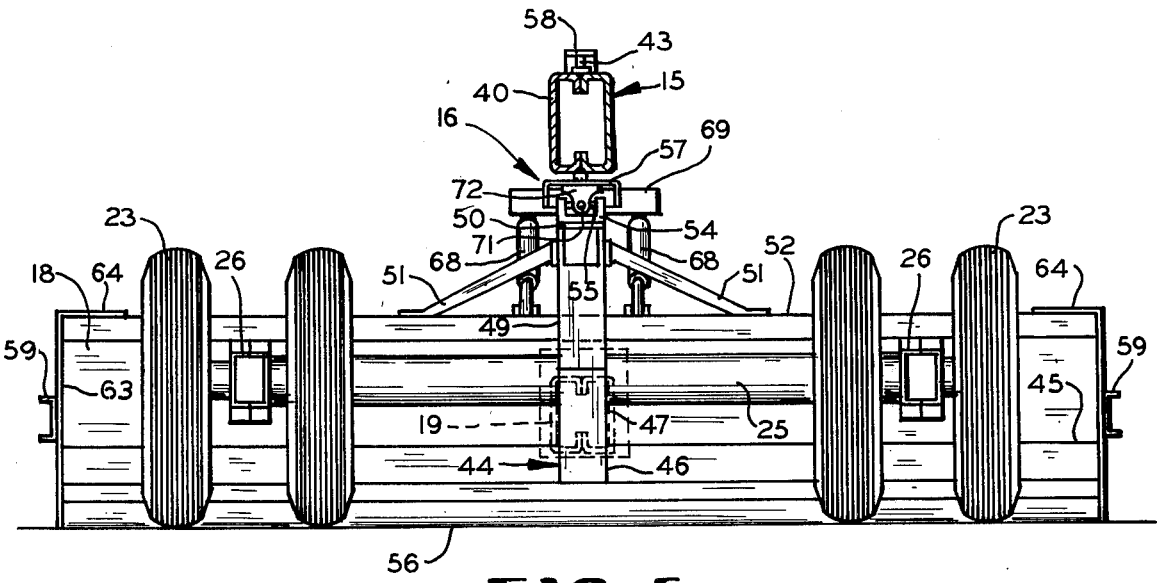
FIG. 5 is a rear elevational view of the gauge frame coupling to the gauge arm and main frame and the mounting for pivoting the main frame ground engaging wheels to alter the frame and blade elevation.

Control of the feed of hydraulic fluid to cylinder 27 is by a system, to be discussed, which is responsive to changes in the attitude of gauge frame 15 relative to main frame 14 as transmitted through gauge yoke 38 supporting spaced gauge wheels 24 on axle 39. Yoke 38 is rigidly fixed on a box beam 40 or like rigid structural member having vertically spaced gudgeons 41 secured on its front end plate 42. Gudgeons 41 are journaled on an upstanding pintal 43 to form a portion of pivoted connection assembly 16. As best seen in FIGS. 3 through 5, a support bracket 44 extends upward from a cross beam 45 on the rear blade 18. Bracket 44 has a leg 46 below and clear of the range of motion of rock shaft 25 extending from beam 45 generally parallel to the ground being worked. A diagonal leg 47 extends to the general area of the vertical plane tangent to the arc of motion of the rotating axes of support wheels 23 as at hub 48. A vertical leg 49 of bracket 44 extends from leg 47 to a base 50 which is stabilized structurally by diagonal brace bars 51 bolted to an upper stiffening flange 52 on the blade 18. Base 50 is formed of a mounting base plate which supports a lower yoke 54 of a universal coupling having a shaft 55 of a universal joint cross extending parallel to the working edge 56 of blade 18 and thus transverse of the main frame 14. This universal coupling supports a gauge arm 57 of channel form having the pintal 43 rigidly secured to its web face and upstanding therefrom. A diagonal support strut 58 extends from gauge arm 57 to the top of pintal 43 to enhance the rigidity of the pintal-gauge arm subassembly.

Blade 18 from leg 46 is secured to the main beam 19 as by welding and is formed into a subframe by side beams or channels 59 and spreader channels 61 providing compression members from side channels 59 to main beam 19. Diagonal struts 62 impose compression on channels 61 when in tension under load conditions. Side plates 63 constrained by side channels 59 and bolted to flange 52 at their top gussets 64 retain soil within control of blade 18 and prevent it spilling around the ends thereof.

The universal coupling yoke 54 bolted or otherwise secured to base 50 to provide a journal having its axis transverse of the main frame 17 at shaft 55 which affords freedom of motion in arcs lying in a plane longitudinal of and perpendicular to the main frame 14. That is in a plane including the longitudinal axis of main beam 19 and normal to working edge 56 of blade 18. The gauge frame or body 15 is free to move vertically with respect to the main frame in the arc around the journal axis 55 thereby changing the fore and aft inclination of the upstanding pintal 43. Such changes in inclination are transmitted to the gauge arm 57 rigidly coupled to pintal 43 and carrying control elements in the form of limit switches 65 and 66 at its distal end 67. Thus, as the inclination of pintal 43 changes in response to the relative up and down motion of the rear of the gauge frame, the opposite motion, namely down or up occurs at the end 67 of gauge arm 57, which, if beyond the range of the dead zone of the controls, will actuate changes in the elevation of main frame 14 and blade 18. Gauge arm 57 is constrained to motion generally in a plane normal to the underlying ground and including or parallel to the longitudinal axis of main frame 14 by the fixed yoke 54 of the universal coupling, particularly its pivot shaft 55 and by a pair of shock absorbers 68 secured to the upper flange 52 of blade 18 and to a cross beam 69 secured to gauge arm 57. The shock absorbers are spaced to provide a wide base stabilizing gauge arm motion and to straddle the elevating mechanism of piston rod 28 and crank 31. They dampen spurious motion of gauge arm 57 and limit the limit switch operation to significant changes in contour. Deviations in the terrain transverse of the implement which tend to raise or drop one of gauge wheels 24 with respect to another are accommodated by a second journaled shaft 71 of the universal coupling cross and its pivotal action provided by a yoke 72 secured to the inner surface of the channel shaped beam 57. Yoke 72 is oriented to provide pivot axle 71 in the plane normal to the underlying ground and parallel to the longitudinal axis of frame 14. The coupling cross or spider maintains shafts 55 and 71 in a common plane.

Rocking of gauge arm 57 ground the axis of shaft 71 is accommodated by the coupling of shock absorber shafts to the beam 69 as by elastomeric bushing receiving threaded ends 73 and secured by nuts 74. Thus, even through turns of the articulated assembly, gauge arm 57 maintains a fore and aft rocking motion determined by the gauge frame motion and the distal end 67 of gauge arm 57 maintains a cooperative relationship in the sensing system 75. Gauge arm 57 is positioned only slightly above the longitudinally oriented axis of shaft 71 so that the switch supporting end plate 76 on distal end 67 rockes in a vertical plane transverse of the main frame axis on a short radius. The sensing system elements on end plate 76 accommodate the limited rocking motion while maintaining the cam-switch relationships for operative control since the limit switch operators maintain engagement with cams 77 and 78.

Sensing system 75 is comprised of two subassemblies, the limit switches 65 and 66 with their mounting plate 76 and the set of actuating cams 77 and 78 on a base 79 supported on the main beam 19 of main frame 14. Cams 77 and 78 have faces broad enough to maintain operating contact with the rollers 81 and 82 of the actuating arms 83 and 84 of the respective limit switches 65 and 66 throughout the range of transverse rocking motion of their mounting plate 76. Advantageously, the cams are of strap material having abruptly rising operating faces 85 and 86 to provide rapid and precise actuation of switches 65 and 66. They are mounted on a base 79 comprising an outer tube 87 telescoped over an inner tube 88 which is mounted on a drive unit 89 pivotally mounted on a pivot pin 91 supported by ears 92 secured to main beam 19. Each cam is movable with respect to outer tube 87 as by a sliding fit of a length 93 of cam 78 into a suitable receptacle in tube 87 in which length 93 can be clamped by cap screw 94 to establish the position of cam operating face 86 along the length of tube 87. A collar 95 which can be slid along the outer surface of tube 87 mounts cam 77 and its position as well as the cam working face 81 can be fixed on tube 87 by cap screw 96 set into the outer wall of tube 87. In practice the cam working faces 85 and 86 are spaced longitudinally of tube 87 about the diameter of actuator rollers 82 and 83 plus a quarter inch. This spacing determines the length of the dead zone. The amount of variation in the position of the switch assembly on plate 76 along the height of the tube 87.

The elevation of the tube 87 above the top of main beam 19 is adjustable by means of a screw drive within the drive element 89 and driven by an electric motor 97. Once the position of cam support base 84 on main frame 14 is established for a given degree of cut of the leveler by positioning the cams and switches to define a dead zone of operation of up limit switch 65 by up cam 77 and down limit switch 66 by down cam 78, the orientation of the gauge arm with those switches in the non-operative relationship to their cams maintains the position of main frame ground engaging wheels 23 on main frame 14 thereby maintaining the established depth of cut.

Cam support assembly is mounted generally perpendicular to the main beam 19. It is tangent to the arcs of motion of gauge arm 57 so that switch actuator rollers 81 and 82 are free to move between an upward tipped position and a downward tipped position. In order to facilitate the requisite orientation several adjustments are available. The mounting position of tube 88 is established by a diagonal brace 98 extending from an ear 99 secured to the top of main beam 19 to a collar 101 embracing tube 88 beyond the range of travel of the lower lip of outer tube 87. Brace 98 has an elongate bolt hold 102 in its lower end and extending generally along its length so that fine adjustment of the position of tube 87 can be obtained and then secured by bolt 103. Switch actuator arms 83 and 84 are of adjustable effective length by means of adjusting screws passing through longitudinal slots in the arms.

The cam assembly is retained in a rotational orientation whereby cam faces 85 and 86 are presented to the limit switch actuators by a guide rod 104 extending from collar 95 and having a length parallel to the axis of the tubes 87 and 88. Rod 104 fits into a slide socket 105 secured to collar 101 or diagonal brace 98 so that outer tube 87 cannot rotate with respect to inner tube 88 as it is reciprocated along its axis by the motor 97 and drive 89.

Drive 89 and motor 97 have a lead screw 80 and nut arrangement with suitable gearing to impart relative rotation which is translated to reciprocation of the outer tube 87 on the inner tube 88. Rotation in one direction raises tube 87 relative to tube 88 and the main frame 14 while rotation in the opposite direction lowers tube 87. Thus the base for mounting the cams, and tube 87, can be positioned at a desired height above frame 14 to simultaneously adjust the positions of cams 77 and 78, and thus the depth of cut and blade edge 56 by virtue of its elevation relative to wheels 23.

In operation, the need for a shallower cut or the depositing of soil, as where gauge wheels 24 are higher than main wheels 23, causes gauge arm 57 to move its end 67 downward thereby actuating up limit switch 65 by carrying its roller 81 against working face 85 of up cam 77. This rocks switch actuating arm 83 clockwise. Over travel of the gauge beam to carry roller 81 beyond the rise 85 of the cam 77 maintains the switch 65 operated until corrective motion of the wheel elevation drive has corrected the gauge frame - main frame alignment or the limit of elevation has been reached. Conversely, a rise in the contour is cut away by lowering blade 18 as the drop of gauge wheels 24 relative to main wheels 23 causes gauge arm 57 to move its end 67 upward and to carry down limit switch roller 82 against the rising face 86 of down cam 78. This rotates down limit switch actuating arm 84 clockwise to a switch actuating position.

Figure 7:
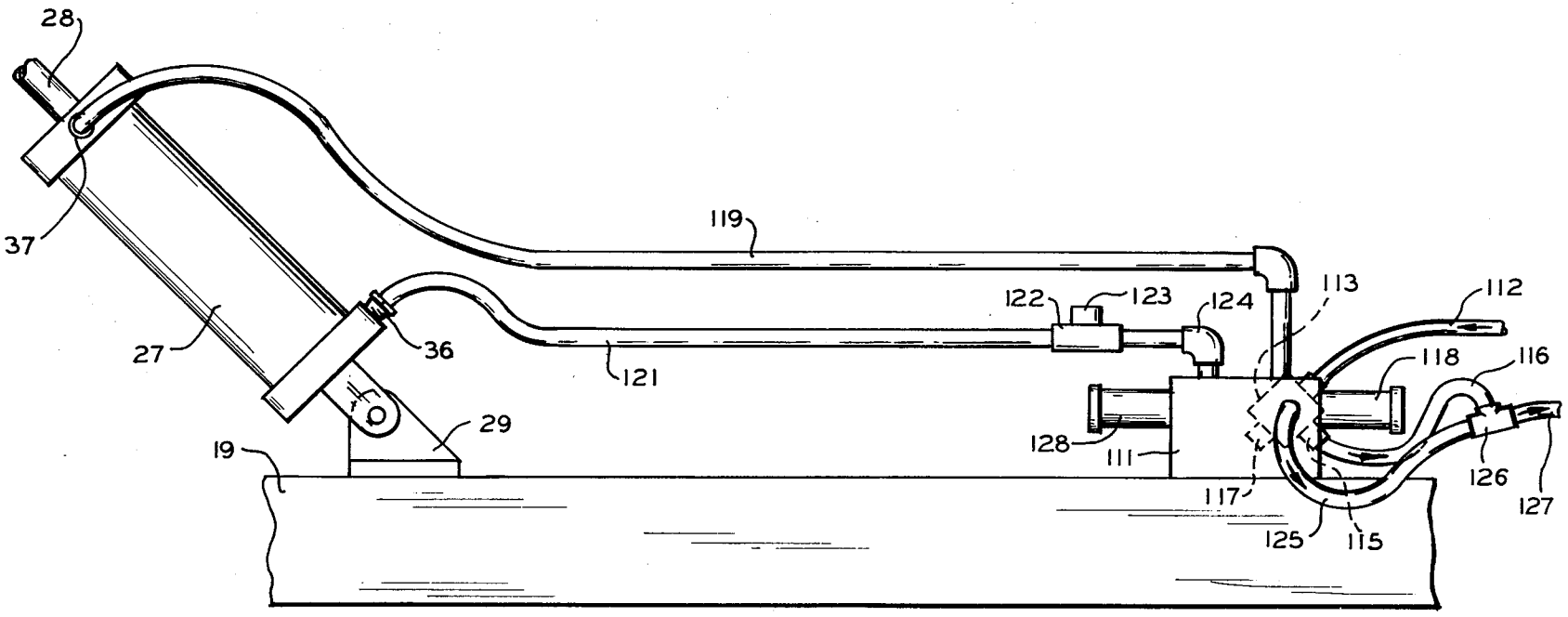
FIG. 7 is an enlarged, simplified, and somewhat schematic view of the hydraulic control system.

Internal details of the hydraulic system have not been shown. A two-way, solenoid controlled hydraulic valve 111 selectively passes hydraulic fluid between the wheel elevation drive cylinder 27 and a suitable source of hydraulic fluid under pressure. One such source which is conveniently applicable to the present implement is the hydraulic system conventionally provided with tractors employed to provide the motive force for the implement. As shown schematically in FIG. 7, an input line 112 feeds fluid from the source to an adjustable metering valve 113 having an output (not shown) to valve 111, an output 115 to a bypass return line 116 and a flow rate adjustment knob 117. Knob 117 can be turned to adjust the proportion of fluid which flows to control valve 111 and thus accommodate different hydraulic systems to which the implement might be connected. Typically, the system is designed to utilize two gallons per minute at the desired speed of response of the drive cylinder 27. A down control solenoid 118 is responsive to the closure of down limit switch 65 while it is actuated by down cam 77 to cause fluid to be passed from control valve 111 through line 119 and the coupling 37 at the outboard end of cylinder 27. This causes the piston to move to the forward end of the cylinder thereby retracting piston rod 28 and rotating crank 31 clockwise to raise main wheels 23 relative to main frame 14 and thereby lowering the frame and blade 18. Fluid ahead of the piston is forced from cylinder 27 through coupling 36 and line 121 to metering valve 122 which is manually adjustable at knob 123 to control the speed at which the frame and blade are lowered. From metering valve 122 the fluid passes through coupling 124 into solenoid control valve 111, through exhaust porting of the valve (not shown) and to a return line 125 coupled by a T 126 to the return line 127 to the fluid source.

A raising of the blade and frame is accomplished by energizing up solenoid 128 in response to the operation of up limit switch 66 by up actuating cam 78. This transfers valve 111 so that feed line 112 is coupled through metering valve 113 and valve 111 to the inboard end of cylinder 27 via line 121 and coupling 36. Fluid behind the piston is expelled from cylinder 27 as the piston and rod 28 are extended, to pass fluid through coupling 37 and line 119 into valve 111, which at this setting passes that fluid through exhaust porting to return lines 125 and 127.

In addition to the automatic control of blade height and the adjustment of the position of cam 77 and/or cam 78 on cam mount 87, adjustment from the tractor operators position 13 is also provided, as from control station 12. Station 12 includes a hydraulic control 129 to admit hydraulic fluid to line 112 from the pressurized source of fluid on the tractor. Suitable automatic cutoff couplings (not shown) are provided between the tractor and lines 112 and 127 so that the land leveler system retains a charge of fluid when disconnected from the tractor. An electrical controller 131, which may be a three position switch for applying in one position, up energization to the electric motor 97 and driving cam base 87 upward to cause switch 65 to lower wheels 23 thereby raising the blade 18, in a second position, down energization, and in a third position, no energization, is provided for the driver to enable him to adjust the normal elevation or cut of the leveler and to raise the blade to a height sufficient for transport of the leveler without leaving his driving station 13. If desired, a third control switch (not shown) can be provided to cut off the electrical power to the solenoids 118 and 128. Further, if solenoid control from the driving station 13 is an advantage, individual solenoid control switches can also be provided at station 12. The electrical controls provide convenient means to parallel the control functions available at station 12 at any other convenient location such as a control station (not shown) on the land leveler frame.

It is to be appreciated that a number of variants of the present invention other than those illustrated are contemplated. For example, the blade elevation relative to the ground engaging elements of the main frame can be accomplished by providing an elevation adjustment of the blade relative to the main frame. The sensing of terrain variations can be translated by hydraulic switches responsive to gauge beam motion. Variations can be made in the lift drive as by an electric motor and screw arrangement. The sensing system can have cam mounting base other than tube 87 and a guide for that base other than inner tube 88. The hydraulic system can be rearranged as with individual up and down control valves. Limits can be placed on the controls which respond to the traverse limits of the elevating mechanism. Multiple controls for hydraulic pressure, electric signals and shifting the setting of dead zone can be provided at the remote control station, and can be mounted at locations other than the driver station on the tractor. Accordingly, it is to be understood that the foregoing detailed description is to be read as illustrative and not in a limiting sense.

What is claimed is:

1. A land leveler comprising:

a substantially horizontal main frame having a front portion, a rear portion, and a longitudinal axis;

a coupling at said front portion of said main frame adapted to be engaged by a tractor;

a ground working blade mounted on said main frame at said rear portion thereof;

at least two spaced wheels mounted to support the rear portion of the main frame on the ground adapted for advance of said frame over the ground parallel to said longitudinal axis;

a gauge frame having a front portion, a rear portion, and a longitudinal axis;

a wheel for supporting said gauge frame at its rear portion;

an upright member on the rear portion of said main frame; a coupling between said upright member and said gauge frame which maintains a constant front to rear inclination relationship between said upright member and said gauge frame whereby said upright member is adapted to be altered in its front to rear inclination relative to said main frame by the relative ground supported position of said gauge frame with respect to said main frame;

a gauge arm coupled to said upright member and extending toward said front portion of said main frame;

a coupling between said upright member and said gauge arm which maintains a constant front to rear inclination relationship between said upright member and said gauge arm, whereby the front to rear inclination relationship between said gauge arm and gauge beam is constant and said gauge arm is adapted to be altered in its inclination relative to said main frame by the relative ground supported position of said gauge frame with respect said main frame;

at least one of said couplings between said upright member and said gauge frame and gauge arm providing pivotal motion around the longitudinal axis of said upright member;

a first control means mounted on said main frame;

a second control means mounted on said gauge arm spaced from said upright member and adapted to cooperate with said first control means;

means to constrain motion of said gauge arm to maintain said second control means in operative relationship with said first control means throughout a range of positional relationships of said main frame and said gauge frame; and drive means for adjusting the relative height of said ground working blade and said wheels responsive to the operative spatial relationships between said first and second control means.

2. A land leveler according to claim 1 wherein said upright member is in the plane generally perpendicular to said main frame and parallel to the longitudinal axis of said main frame.

3. A land leveler according to claim 2 including a pivotal mounting between said main frame and said upright member having a first pivot axis transverse of the longitudinal axis of said main frame.

4. A land leveler according to claim 2 wherein said two spaced wheels are on a common axis of rotation of said upright member is located generally in the vertical plane aligned with the axis of rotation of said two spaced wheels.

5. A land leveler according to claim 1 wherein at least one of said control means includes a base and an up control and a down control element mounted upon said base, and including adjustable positioning means for said base for said one of said control means for adjusting said one control means with respect to the structure upon which it is mounted whereby the relative positions between said up and down control elements is maintained while the relative position between said gauge arm and said main frame at which said control means are operative is adjustable to adjust the depth of said blade without apprecably altering the range of operation positions between the actuating relationships for said up and down control elements.

6. A land leveler according to claim 5 including control drive means to reciprocate said adjustable positioning means along a path corresponding to the path of motion of said gauge arm and said second control means relative to said main frame and said first control means.

7. A land leveler according to claim 6 including a drive means control remote from said control drive means.

8. A land leveler according to claim 6 wherein said adjustable positioning means is mounted on said main frame and is arranged to reciprocate in a generally vertical direction, said positioning means including a guide for said base coupled to said guide for motion with respect thereto; and said control drive operates between said main frame and said base for moving said base along said guide.

9. A land leveler according to claim 8 wherein said control drive includes an electric motor; a screw threaded shaft and cooperating nut adapted to be driven in relative rotation by said motor; one of said shaft and nut being secured to said main frame and the other of said shaft and nut being secured to said base; and an electrical control for said motor remote from said motor and said base.

10. A land leveler according to claim 5 wherein one of said control elements is movable on said base with respect to its elevational relationship to said main frame.

11. A land leveler according to claim 5 wherein said up and down control elements are movable on said base with respect to each other over a range of elevational relationships to said main frame.

12. A land leveler comprising:

a substantially horizontal main frame having a front portion, a rear portion, and a longitudinal axis;

a coupling at said front portio of said main frame adapted to be engaged by a tractor;

a ground working blade mounted on said main frame at said rear portion thereof;

at least two spaced wheels mounted to support the rear portion of the main frame on the ground adapted for advance of said frame over the ground parallel to said longitudinal axis;

a gauge frame having a front portion, a rear portion, and a longitudinal axis;

a wheel for supporting said gauge frame at its rear portion;

an upright member on the rear portion of said main frame in the plane generally perpendicular to said main frame and parallel to the longitudinal axis of said main frame, said upright member coupling said gauge frame to said main frame and adapted to be altered in its front to rear inclination by the relative grounds supported position of said gauge frame with respect to said main frame; a universal joint mounting said upright member on said main frame and including a first yoke fixed to said main frame; a second yoke fixed to said upright member; and pivot shafts journaled in said yokes and having their axes cross in a common plane, one of said axes being transverse of the longitudinal axis of said main frame; a gauge arm coupled to said upright member and extending toward said front portion of said main frame; a first control means mounted on said main frame; a second control means mounted on said gauge arm spaced from said upright member and adapted to cooperate with said first control means; means to constrain motion of said gauge arm to maintain said second control means in operative relationship with said first control means throughout a range of positional relationships of said main frame and said gauge frame; and drive means for adjusting the relative height of said ground working blade and said wheels responsive to said control means.

* * * * *